US011846170B1

(12) United States Patent
Phillippi et al.

(10) Patent No.: US 11,846,170 B1
(45) Date of Patent: Dec. 19, 2023

(54) DETECTION OF SOLID DELIVERY FOR SLURRY MIXING

(71) Applicant: Halliburton Energy Services, Inc., Houston, TX (US)

(72) Inventors: Max Lynn Phillippi, Duncan, OK (US); Mehdi Mazrooee, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/104,948

(22) Filed: Feb. 2, 2023

(51) Int. Cl.

| | |
|---|---|
| ***E21B 43/26*** | (2006.01) |
| ***B01F 35/71*** | (2022.01) |
| ***E21B 43/267*** | (2006.01) |
| ***B01F 101/49*** | (2022.01) |

(52) U.S. Cl.
CPC .... *E21B 43/2607* (2020.05); *B01F 35/71775* (2022.01); *E21B 43/26* (2013.01); *E21B 43/267* (2013.01); *B01F 2101/49* (2022.01)

(58) Field of Classification Search
CPC .... E21B 43/2607; E21B 43/26; E21B 43/267; B01F 35/71775; B01F 2101/49
See application file for complete search history.

(56) References Cited

U.S. PATENT DOCUMENTS

| | | | | |
|---|---|---|---|---|
| 4,443,109 | A * | 4/1984 | Watts | B01F 33/80514 366/186 |
| 4,506,982 | A * | 3/1985 | Smithers | B01F 33/502 366/65 |
| 4,840,292 | A * | 6/1989 | Harvey | G05D 11/132 222/1 |
| 4,871,116 | A * | 10/1989 | Banner | G21H 5/02 241/63 |
| 5,190,374 | A * | 3/1993 | Harms | E21B 43/2607 366/175.2 |
| 5,281,023 | A * | 1/1994 | Cedillo | B01F 35/82 366/20 |
| 2017/0028368 | A1* | 2/2017 | Oehring | F04B 17/06 |
| 2018/0313677 | A1* | 11/2018 | Warren | E21B 21/062 |

* cited by examiner

*Primary Examiner* — James G Sayre
(74) *Attorney, Agent, or Firm* — NOVAK DRUCE CARROLL LLP

(57) ABSTRACT

Described herein are systems, apparatuses, methods and computer-readable media that monitor and evaluate the density of a slurry of materials provided to a wellbore. Such systems and methods may be used when a volume of solids used in a hydraulic fracturing process is mixed with a volume of fluid when the slurry of materials is formed according to a hydraulic fracturing rule. This slurry may then be provided to the wellbore such that a hydraulic fracturing process may be completed. Here the solids may include a specific type of sand, a proppant material, or other material. Fluids used to make the slurry may include water, chemicals, or other liquids. A density of the slurry may be identified based on measurements that identify a mass of solids and volume of fluid that are provided to form the slurry.

20 Claims, 8 Drawing Sheets

DETECTION OF SOLID DELIVERY FOR SLURRY MIXING

TECHNICAL FIELD

The present disclosure is generally directed to collecting and evaluating data associated with a wellbore activity. More specifically, the present disclosure is directed to providing a slurry of materials that includes a controlled mass of solids to the wellbore.

BACKGROUND

When managing a wellbore hydraulic fracturing process, a slurry of materials is provided to a wellbore such that the slurry of materials includes a concentration of solids mixed in a volume of fluid. Typically, concentrations of solids included in the slurry, or the density of the slurry are identified by a radioactive densometer. A radioactive densometer may be located at a line or pipe that provides the slurry to a wellbore after a mass of solids has been mixed with a volume of fluid. Radioactive densometers include a radioactive source (e.g., a mass of cesium 137) that emits radioactive particles into a slurry that includes solids (e.g., sand) and a fluid (e.g., water). The radioactive densometer also includes a radiation sensor that senses levels of radioactive particles that pass through the slurry after being emitted from the radioactive source. As the density of the material flow increases, the level of radioactive particles that reach the radiation sensor reduces. This is because, the solids included in the flow of materials absorb radiation more than fluids included in the slurry.

The shipment of radioactive materials between certain municipalities or countries is controlled because of concerns that such radioactive materials could be used for nefarious purposes. This means that companies may not be easily able to ship radioactive densometers from one location to another without adhering to sets of regulations that can vary from one country to another. Such regulations can mean that a radioactive densometer cannot be timely shipped to a location where a wellbore is located. Any delay in shipping a radioactive densometer to a location may thus result in wellbore operations being paused.

BRIEF DESCRIPTION OF THE DRAWINGS

In order to describe the manner in which the features and advantages of this disclosure can be obtained, a more particular description is provided with reference to specific implementations thereof which are illustrated in the appended drawings. Understanding that these drawings depict only exemplary implementations of the disclosure and are not therefore to be considered to be limiting of its scope, the principles herein are described and explained with additional specificity and detail through the use of the accompanying drawings in which.

DETAILED DESCRIPTION

Figure 1A:
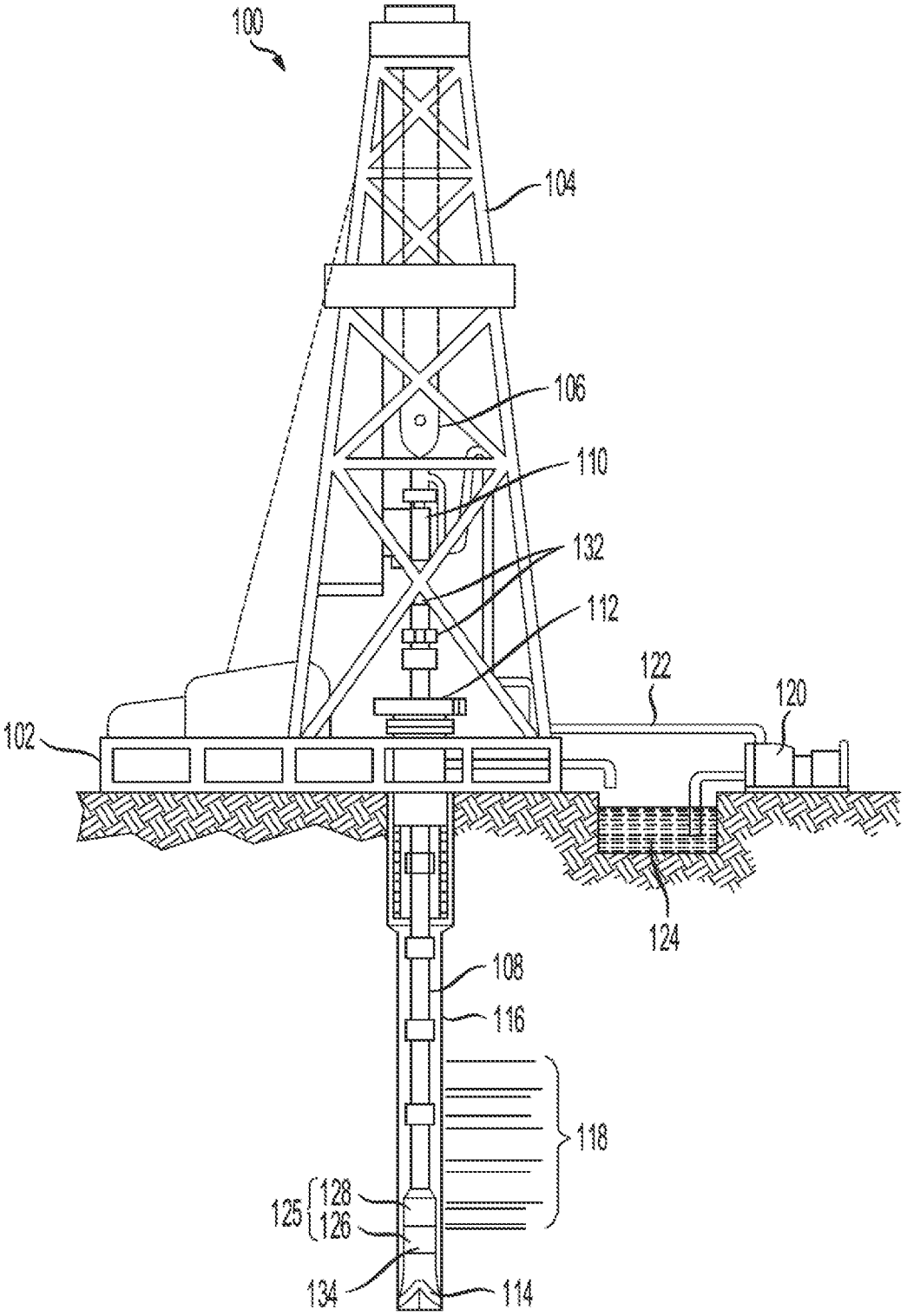
FIG. 1A is a schematic diagram of an example logging while drilling wellbore operating environment, in accordance with various aspects of the subject technology.

Various aspects of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the methods and apparatus described herein. However, it will be understood by those of ordinary skill in the art that the methods and apparatus described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the present disclosure.

Described herein are systems, apparatuses, processes (also referred to as methods), and computer-readable media (collectively referred to as "systems and techniques") for monitoring and evaluating the density of a slurry of materials provided to a wellbore. Systems and techniques of the present disclosure may be used when a volume of solids used in a hydraulic fracturing process is mixed with a volume of fluid when the slurry of materials is formed. Here the solids may include sand, a specific type of sand, a proppant material, or other material used in the slurry. Fluids used to make the slurry may include water, chemicals, or other liquids that are used during completion of a hydraulic fracturing process.

A mechanism that mixes solids and fluids to create the slurry may be referred to as a slurry blender. This slurry blender may be comprised of or include a mechanism that delivers a mass of the solids. The mechanism that delivers the mass of the solids may be screw type mechanism that may be referred to as an auger, a material screw, or a sand screw. Depending in a particular configuration, this auger, screw, or sand screw may provide wetted or dry solid materials to other parts of the slurry blender such that the slurry can be made according to a set of rules or conventions.

A particular hydraulic fracturing process may use one or more different types of solid materials and a type of solid material may be selected based on material availability or based on a rule associated with hydraulic fractures in particular types of Earth formations. Alternatively, or additionally, a set of hydraulic fracturing rules may identify a slurry density (e.g., a mass of solids included in a volume of fluid) that should be used when fractures are made or completed in an Earth formation. These rules may also identify a different density for each type of solid. For example, a density of a slurry that includes a fine sand and water may be different than a density of a slurry that includes a coarse sand and water.

An auger that is used to provide the solid may be coupled to a motor that drives the auger. Such a motor may be a hydraulic motor or an electric motor, for example. An amount of power or a load provided to the auger may correspond to a mass of a particular type of solid that is being moved by the auger. The power or load required to move the solid with the auger may also vary with a type of solid. For example, in instances when the solid must be moved from a lower height to a greater height, a solid with a greater volumetric density may tend to require more power to move than a solid with a lower volumetric density. One reason for this is that a volume X of the solid with the lower volumetric density will weigh less than the sold with the higher volumetric density. Because of this, an auger with a volume of X cubic meters lifting Y cubic meters of solids per second will have to work harder when lifting the solids with the higher volumetric density as compared to the auger lifting the solids with the lower volumetric density. The opposite may be true when the auger is setup in a configuration that moves the solids from a greater height to a lower height. In either instance, a specific auger configuration may be associated with load characteristics based on a type of solids being moved by the auger and an auger configuration.

FIG. 1A is a schematic diagram of an example logging while drilling wellbore operating environment, in accordance with various aspects of the subject technology. The drilling arrangement shown in FIG. 1A provides an example of a logging-while-drilling (commonly abbreviated as LWD) configuration in a wellbore drilling scenario 100. The LWD configuration can incorporate sensors (e.g., EM sensors, seismic sensors, gravity sensor, image sensors, etc.) that can acquire formation data, such as characteristics of the formation, components of the formation, etc. For example, the drilling arrangement shown in FIG. 1A can be used to gather formation data through an electromagnetic imager tool (not shown) as part of logging the wellbore using the electromagnetic imager tool. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near the drill bit 114. As drill bit 114 extends into the wellbore 116 through the formations 118 and as the drill string 108 is pulled out of the wellbore 116, logging tools 126 collect measurements relating to various formation properties as well as the orientation of the tool and various other drilling conditions. The logging tool 126 can be applicable tools for collecting measurements in a drilling scenario, such as the electromagnetic imager tools described herein. Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor a performance of the tool, process logging data, and/or carry out one or more aspects of the methods and processes of the present disclosure.

The bottom-hole assembly 125 may also include a telemetry sub 128 to transfer measurement data to a surface receiver 132 and to receive commands from the surface. In at least some cases, the telemetry sub 128 communicates with a surface receiver 132 by wireless signal transmission (e.g., using mud pulse telemetry, EM telemetry, or acoustic telemetry). In other cases, one or more of the logging tools 126 may communicate with a surface receiver 132 by a wire, such as wired drill pipe. In some instances, the telemetry sub 128 does not communicate with the surface, but rather stores logging data for later retrieval at the surface when the logging assembly is recovered. In at least some cases, one or more of the logging tools 126 may receive electric power from a wire that extends to the surface, including wires extending through a wired drill pipe. In other cases, power is provided from one or more batteries or via power generated downhole.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
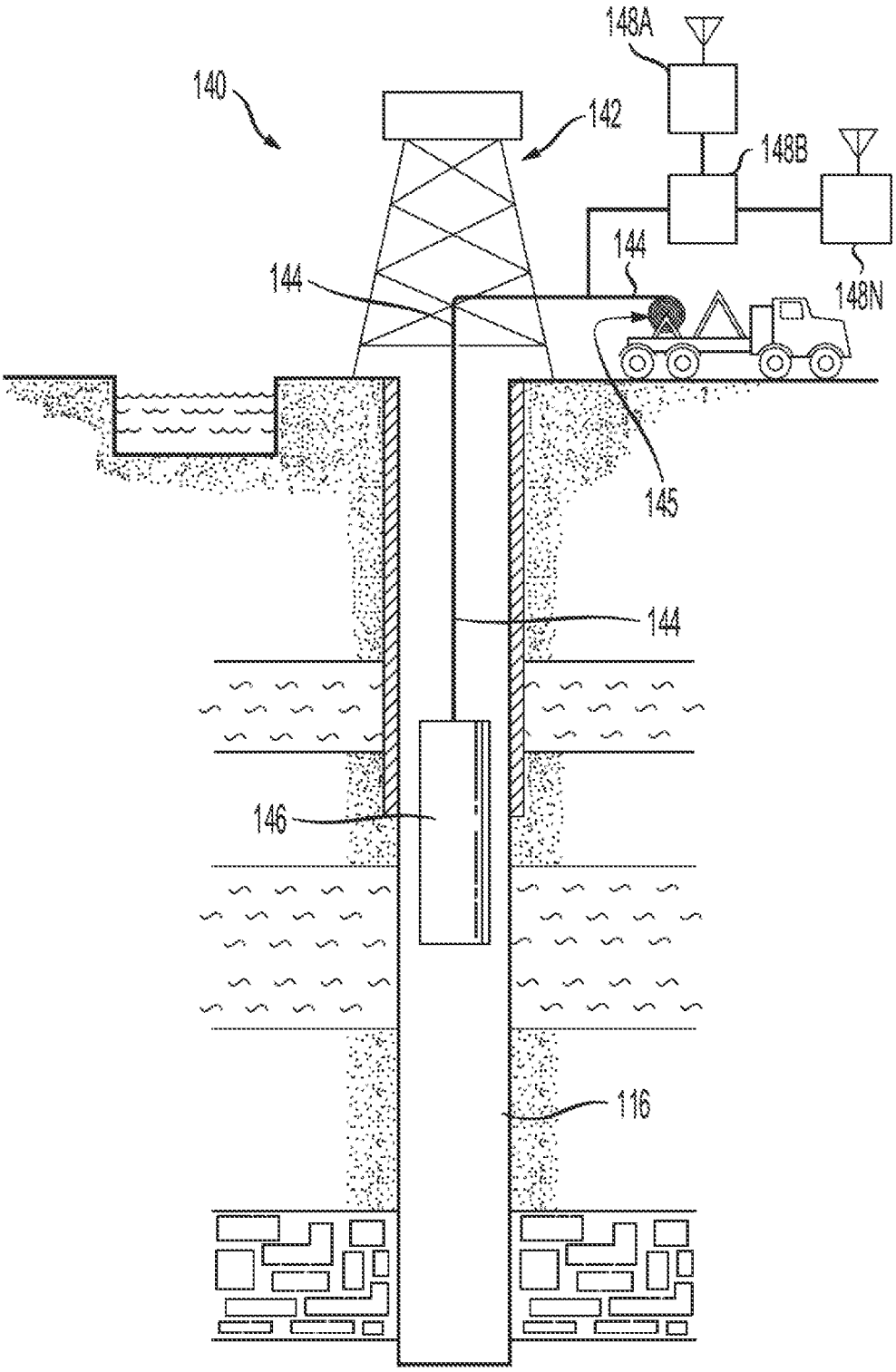
FIG. 1B is a schematic diagram of an example downhole environment having tubulars, in accordance with various aspects of the subject technology.

FIG. 1B is a schematic diagram of an example downhole environment having tubulars, in accordance with various aspects of the subject technology. In this example, an example system 140 is depicted for conducting downhole measurements after at least a portion of a wellbore has been drilled and the drill string removed from the well. An electromagnetic imager tool (not shown) can be operated in the example system 140 shown in FIG. 1B to log the wellbore. A downhole tool is shown having a tool body 146 in order to carry out logging and/or other operations. For example, instead of using the drill string 108 of FIG. 1A to lower the downhole tool, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars. The downhole tool can include an applicable tool for collecting measurements in a drilling scenario, such as the electromagnetic imager tools described herein.

The illustrated wireline conveyance 144 provides power and support for the tool, as well as enabling communication between data processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. The processors 148A-N can be integrated as part of an applicable computing system, such as the computing device architectures described herein. Moreover, power can be supplied via the wireline conveyance 144 to meet power requirements of the tool. For slickline or coiled tubing configurations, power can be supplied downhole with a battery or via a downhole generator.

Hydraulic fracturing processes require that a slurry of materials be provided to wellbore such that fractures may be made or completed in an Earth formation. Such a slurry may include a mass of solid particles (solids) mixed in a volume of fluid, that may be a liquid form. The slurry may be generated on site during a hydraulic fracturing process. Here volumes of liquid may be mixed with masses of solids to form a slurry with a desired density. The density of a particular slurry may vary based on the volumetric density of the solid and the mass of the solid mixed into a volume of fluid. In such instances, the volumetric density of the fluid may be known and possibly used to identify a combined density of the slurry. The solids used in the slurry may be of a type that is suited for operations associated with particular types of Earth formations. Rules may be used to identify slurry densities that should be used in a particular hydraulic fracturing process. Such rules may specify masses of particular types of solids that should be mixed in a volume of fluid used to form a slurry of a specific density. Examples of different types of solids include, yet are not limited to fine sand, coarse sand, and hydraulic fracturing proppants of any sort.

In order to mix solid particles with a fluid, both the solid particles and the fluid may be provided to a blending system that forms a slurry that includes the solid particles and the fluid. A mechanism used to deliver the solid particles may include a mechanism in the shape of a screw or an auger bit. Such a "screw" or auger bit may have a raised helical shaped thread that surrounds a center shaft of the screw along a length of the screw. A total area located along the length of the screw and between the raised helical shape and the center shaft of the screw (or auger bit) corresponds to a volume of space that can be filled with the solid particles. Such a "screw" may be referred to as a screw, a sand screw, an auger, an auger bit, or an auger screw. A mechanism that includes such an auger and an outer casing may be referred to as an auger mechanism. This casing may be a tube that has a larger diameter than a largest diameter of the auger that is placed inside of the casing. In such an instance, the casing may help keep the solid particles from falling away from the auger as the auger rotates.

Systems and techniques of the present disclosure may identify masses of solids that are used in a slurry that includes solid particles and a fluid. A load associated with driving an auger may correspond to a mass of the solids moved by an auger per unit time. This means that the mass of the solids moved by the auger may vary with a number of rotations per minute that the auger rotates. The mass of solids may also vary with the diameter of the auger or a volume associated with the auger.

When the auger bit rotates solids, an amount of power or load associated with operation of the auger may vary with the mass of the solids moved per unit time. An amount of power and/or load required to drive an auger may vary based on a type of solid material moved by the auger and based on an RPM that the auger rotates. Systems and techniques of the present disclosure may monitor auger load and/or power provided to turn an auger and this load or power may be used to identify a mass flow rate of the solids that the auger moves over time. Depending on a particular implementation, a load associated with driving the auger may be identified using a pressure provided to a hydraulic motor of an auger. In other instances, a current and or an amount of electric power provided to an electric motor of the auger may be used to identify the load associated with driving the auger. When electric power is used, that power may be identified by sensing a current and multiplying the sensed current by an operating voltage of the electric motor.

A flow rate of a fluid provided to a blending unit may also be identified, for example, using a flow meter. Data from the flow meter may be used to identify a volume of fluid combined with the mass (and/or volume) of the solids per unit time by the bending unit. From this information, a density of the slurry may be identified. In such an instance, the density will be a function of the volumetric density of the solids, a mass of the solids, and a volume of liquid included in a volume of a slurry that includes the mass of the solids and the volume of liquid. As such, the density of the slurry may be identified without use of a radioactive densometer.

Figure 2:
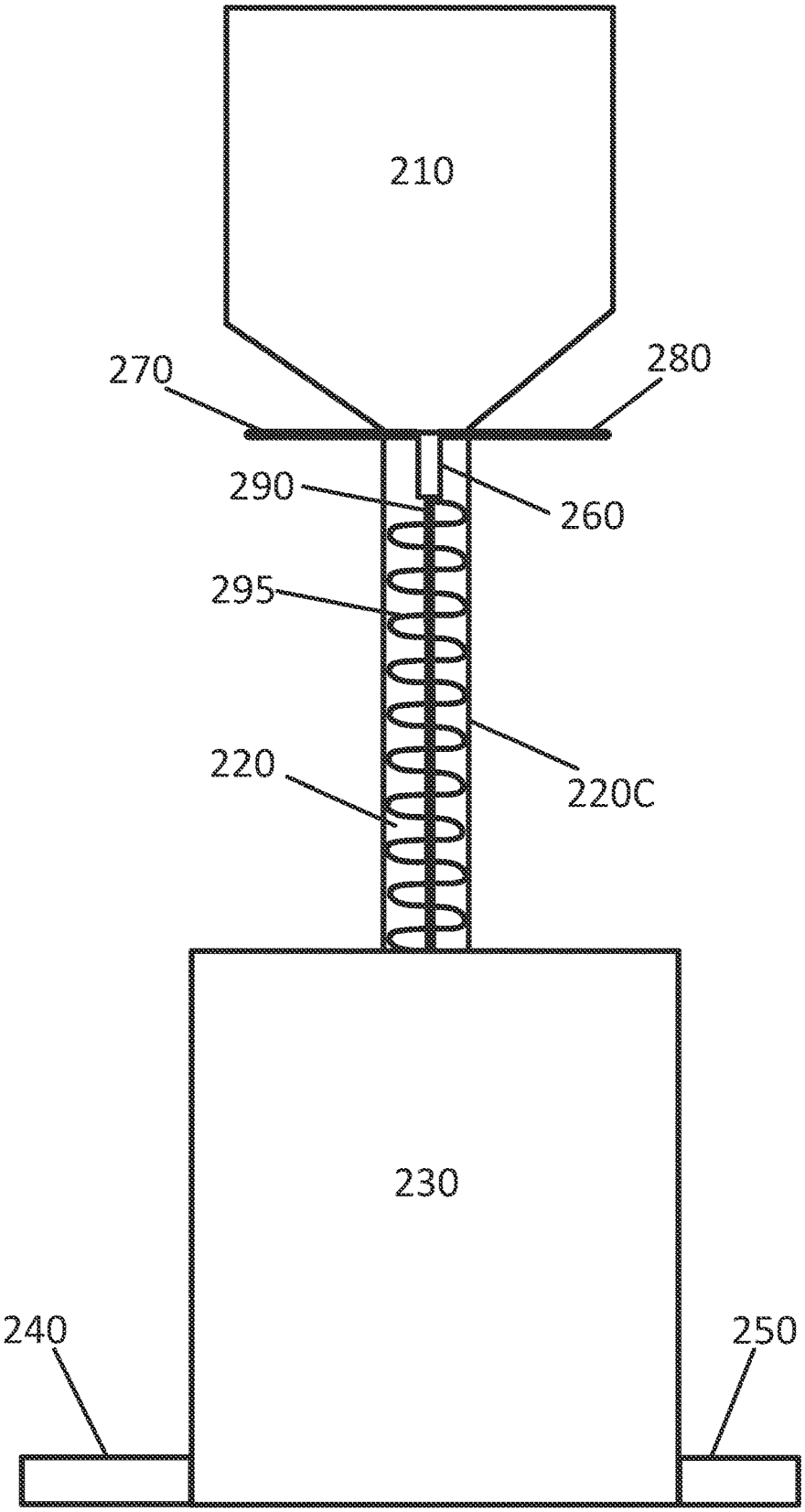
FIG. 2 illustrates a first configuration of components that may be included in an apparatus that mixes solid particles with a fluid.

FIG. 2 illustrates a first configuration of components that may be included in an apparatus that mixes solid particles with a fluid. Such an apparatus is referred to herein as a slurry blender. FIG. 2 includes solid source container 210, an auger mechanism 220, a mixing unit 230, an input fluid pipe 240, and an output slurry pipe 250. Auger mechanism 220 may include motor 260, shaft 290, auger screw 295, and casing 220C. FIG. 2 also includes power lines 270 and 280 that may be used to provide a pressurized hydraulic fluid to motor 260. When motor 260 is an electric motor, electric power (voltage and current) may be provided to motor 260 via power lines 270 and 280. Casing 220C may have an inner diameter that is slightly larger than an outer diameter of auger screw 295. Casing 220C may be designed to retain solid particles between threads of auger screw 295. As such, casing 220C may prevent solid particles from escaping the threads of auger screw 295 in a direction perpendicular to an inner portion of casing 220C.

In instances when a hydraulic motor is used, a gasoline or diesel-powered engine (not illustrated in FIG. 2) may be used to power a hydraulic pump that pressurizes a hydraulic fluid when the hydraulic fluid is provided to motor 260 via power line 270. After the hydraulic fluid passes through motor 260, the hydraulic fluid may be passed back the gasoline or diesel-powered hydraulic pump via power line 280. In instances when an electric motor is used, power lines 270 and 280 may be used to provide a voltage and current to motor 260. Any type of electric motor (e.g., an alternating current motor or a direct current brushless motor) may be used.

In operation, solid source container 210 may be filled with a particular type of solid (e.g., a fine sand) and the motor may be powered on and set to turn at a specific number of rotations per minute (RPM). As soon as the motor is turned on, shaft 290 of the auger mechanism 220 will turn and this will force auger screw 295 to turn. As auger screw 295 turns, particles of the solids will move from source container 210 to internal parts of auger mechanism 220. Auger screw 295 will move the solid particles through the auger mechanism 220 to mixing unit 230. At this time a fluid (e.g., water and/or a chemical) may be provided to input fluid pipe 240 and a slurry (that is a mixture of solids and the fluid) will move out of mixing unit 230 through output slurry pipe 250. The slurry may be output from the slurry blender via output slurry pipe 250 as the slurry is provided to a wellbore as part of a hydraulic fracturing process. Such a slurry may be pumped at a desired pressure to the wellbore using a slurry pump not illustrated in FIG. 2. Such a slurry pump may be coupled to output slurry pipe 250 of the slurry blender. This slurry pump may be any pump known in the art that is capable of pumping a slurry that includes solids. Examples of such slurry pumps include, yet are not limited to a centrifugal pump, a progressive cavity pump, a diaphragm pump, or a disc pump. Systems and techniques of the present disclosure may identify masses of solids that are used to form a slurry that includes a mixture of solid particles and a fluid. A load associated with driving an auger bit or auger screw mat correspond to a mass of the solids moved by an auger per unit time.

Figure 3:
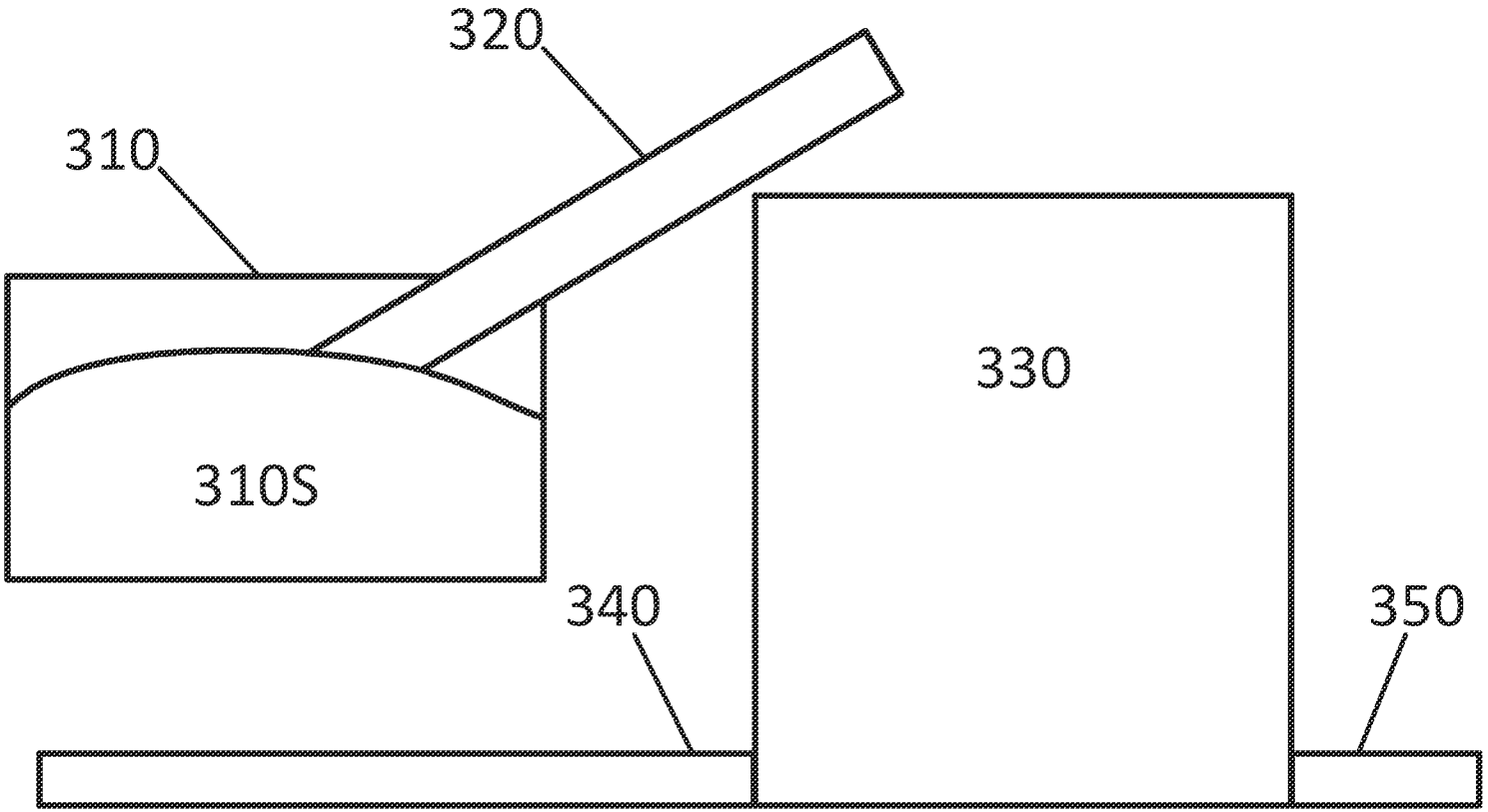
FIG. 3 illustrate a second configuration of components that may be used to generate a slurry that includes a mixture of solid particles and a fluid.

FIG. 3 illustrates a second configuration of components that may be used to generate a slurry that includes a mixture of solid particles and a fluid. FIG. 3 includes many of the same components as those discussed in respect to FIG. 2, here however, auger mechanism 320 moves solid 310S from a lower position to a higher position. FIG. 3 includes solid source container 310, an auger mechanism 320, a mixing unit 330, an input fluid pipe 340, and an output slurry pipe 350. The sold source container 310 of FIG. 3 stores solid 310S into which an input portion of auger mechanism 320 may be inserted or buried.

As discussed in respect to FIG. 2, auger mechanism 320 may include a motor, a shaft, an auger screw, and a casing. Here again a motor that drives the auger screw via the shaft may be powered by power lines (not illustrated in FIG. 3) like those discussed in respect to FIG. 2.

In operation, the auger screw in auger mechanism 320 will turn/rotate and begin moving solid particles 310S from solid source container 310 to mixing unit 330 as a fluid is provided to fluid input 340. The solids 310S and fluid may form a slurry that include solids 310S and slurry may be passed out of mixer 330 via slurry pipe 350. The slurry may flow directly to a wellbore or may be provided to a slurry pump that pumps the slurry to the wellbore. While not illustrated in FIG. 2 or FIG. 3, mixing units 230 or 330 may include a stirrer that stirs the slurry.

Figure 4:
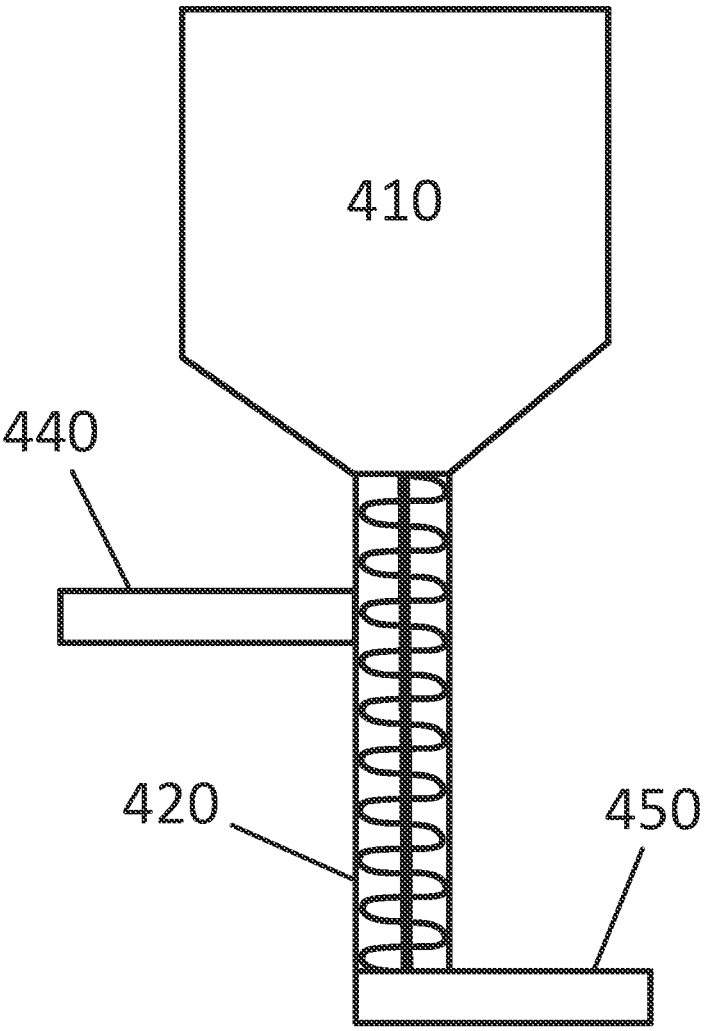
FIG. 4 illustrates yet another configuration of components that may be used to generate a slurry that includes a mixture of solid particles and a fluid.

FIG. 4 illustrates yet another configuration that may be used to generate a slurry that includes a mixture of solid particles and a fluid. The slurry blender of FIG. 4, however, does not include a mixing unit that is separate from an auger mechanism like the mixing unit 230 of FIG. 2 or the mixing unit 330 of FIG. 3. FIG. 4 includes solid source container 410, an auger mechanism 420, an input fluid pipe 440, and an output slurry pipe 450.

In operation, solids included in source container 410 may be moved by auger mechanism 420 while fluid is being provided to the auger mechanism when the slurry of solids and fluid are mixed in auger mechanism 420. After the slurry is formed, the slurry may flow out of slurry output pipe 450 to a wellbore. Here again, the slurry may be provided to a slurry pump via slurry pipe 450 and the slurry pump may then pump the slurry to the wellbore.

FIG. 4 illustrates that the auger mechanism used to move solids may be configured to also move fluids while mixing a fluid (e.g., a liquid) with solids when the slurry is created in the auger mechanism. While not illustrated in the figures, input fluid pipe could provide fluid to a solid source container like source containers 210, 310, or 410 of FIGS. 2-4.

Figure 5:
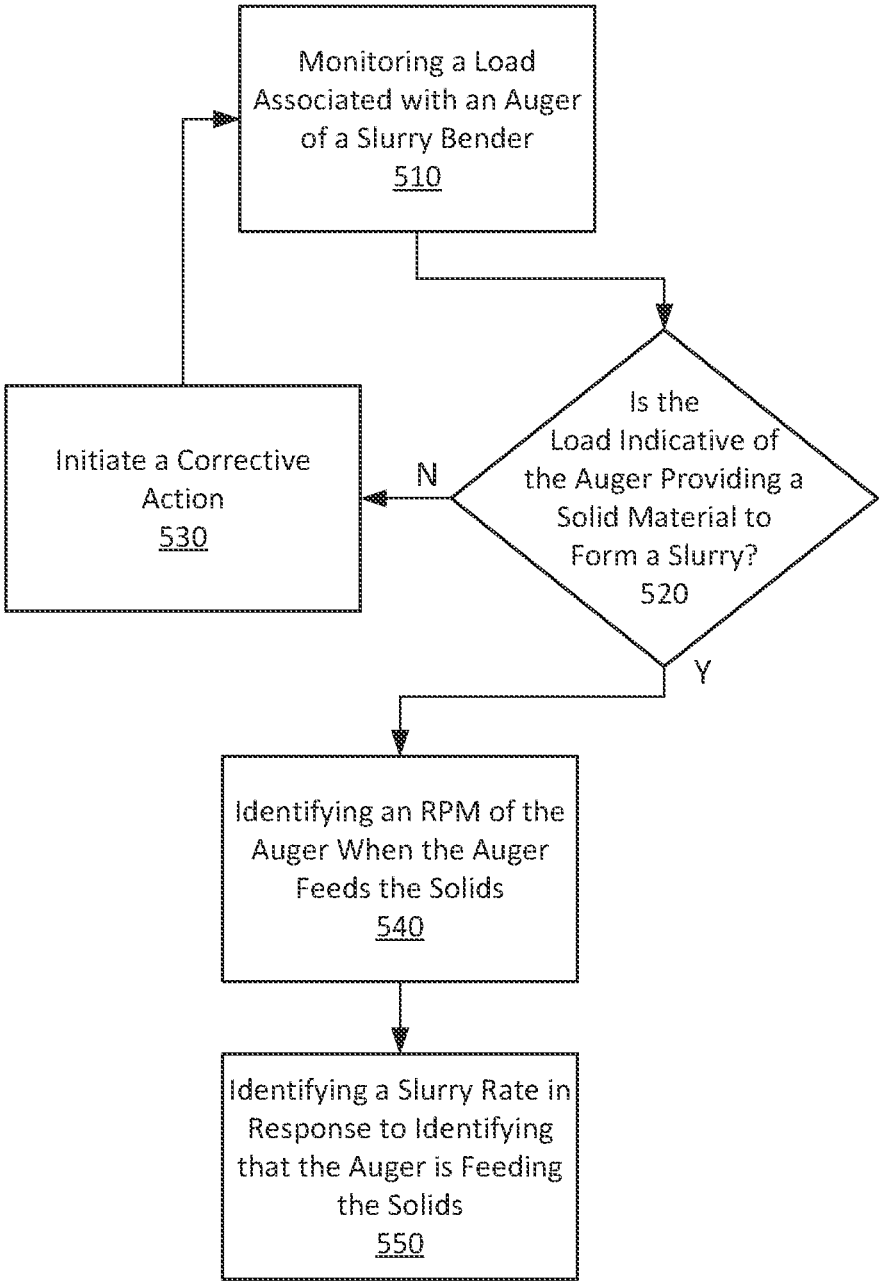
FIG. 5 illustrates an example process for monitoring materials that are provided to make a slurry used during a wellbore process such that a density of the slurry can be controlled according to a set of wellbore processing rules.

FIG. 5 illustrates an example process for monitoring materials that are provided to make a slurry used during a wellbore process such that a density of the slurry can be controlled according to a set of wellbore processing rules. Block 510 of FIG. 5 is where a load associated with an auger of a slurry bender apparatus is monitored. This may include receiving sensor data from which the load may be determined. In some instances, a pressure sensor may be used to monitor a pressure of a hydraulic fluid provided to drive the auger when the auger provides solids that are combined with a fluid to create a slurry. The hydraulic pressure measured by the sensor may correspond to a torque provided to a shaft that rotates the auger. As such, the hydraulic pressure that drives a hydraulic motor of an auger may be or may correspond to the load that drives the auger.

In other instances, the load required to drive the auger may equal or correspond to an amount of electric power consumed by an electrical motor or to an amount of electric current provided to the electrical motor. In such instance, a sensor may sense an amount of electric current provided to the electric motor and that current may correspond to the load directly. Alternatively, or additionally, a voltage applied to the electric motor may be sensed and the power may be identified by performing a calculation consistent with Ohms law (e.g., where power equals a voltage multiplied by a current). Such a calculation may include multiplying the voltage by the current and may also include multiplying this product by 0.707 to identify an amount of RMS (root mean squared) power provided to the motor.

At block 520, a determination may be made that the load indicates that the auger is actively feeding solid materials to form a slurry. The determination made at block 520 may include comparing a load identified at block 510 with load data stored at a database. The stored load data may identify a load associated with operation of an empty auger mechanism, a load associated with the auger mechanism being full of solid materials of different types, and loads associated with the auger being partially filled with the solid materials. When a determination is made at block 520 that the load is not indicative of the auger providing solid materials, program flow may move to block 530 where a corrective action is initiated. Such a corrective action may include sending warning messages to operators of the auger. This message may not be sent to the operators until after a delay time. This delay time may allow the auger to begin to feed solid materials. As such, the delay time may correspond to a time that allows the auger to be primed (e.g., filled with solids) for operation from an empty condition. In certain instances, this corrective action may result in the operators validating that the auger is placed in position where it can actively pickup and feed the solid materials or this corrective action may include the operators providing additional solid materials to a solid source container. When determination step 520 identifies that the auger is actively feeding the solid materials, program flow may move to block 540 where a number of rotations per minute (RPM) of the auger may be identified. This RPM may be identified at a time that the auger is actively feeding the solids when a slurry is being made.

A slurry rate may then be identified at block 540 of FIG. 5. The slurry rate may be identified in response to the identification that the auger is actively feeding the solids. Step 550 may identify a flow rate of the solids as a function of the RPM and an identified load of the auger. In an instance when the load of the auger corresponds to the auger being in a full condition when moving a particular type of solids and rotating at the identified RPM, a solid flow rate may be identified using Formula 1 below. Formula 1 identifies that the solid flow rate equals the RPM times a mass associated with the solid that is transferred in one rotation of the auger. The mass that the auger moves in a single rotation may correspond to a type of solid material that is being moved by the auger and may correspond to how full the auger is.

(the solid mass flow rate)=(the RPM)*[(solid mass/auger revolution)] Formula 1: Solid Mass Flow Rate Equation The mass that the auger moves in a single rotation may correspond to a type of solid material that is being moved by the auger and may correspond to how full the auger is. How full the auger is may be identified based on the load required to turn the auger when the auger moves a specific type of material at the identified RPM. At least over a certain range, the auger load may vary linearly according to RPM and/or an auger fill percentage. For example, the auger load may change according to a linear equation as the auger full percentage varies between 50% full and 100% full when the auger rotates at 60 RPM.

Whether hydraulic pressure, electric current, measures of electric power, or some other values are used to identify the auger load, data that cross references these values with the auger moving specific types of sold materials may be stored at a database. The determined load and RPM may be used to identify whether the sold materials are being provided at a rate that corresponds to a desired solid material flow rate. Here again a set of rules may identify acceptable sold material flow rates that can be used to create a slurry of materials that is provided to a wellbore.

While not illustrated in FIG. 5, other actions may be performed to identify that adequate amounts of materials are being provided to make the slurry. For example, a flow meter may be used to identify a flow of fluid to an apparatus that mixes the solids and the fluid. This fluid flow rate may correspond to a volumetric flow rate of the fluid used to make the slurry. The volumetric flow rate of the fluid and the flow rate of the solids correspond to a volumetric density of a slurry when the fluid and solids are sufficiently mixed/combined into a slurry. As such, rules governing a hydraulic fracturing process may specify fluid volumetric flow rates and mass or volumetric flow rates of solids that are used to make the slurry.

Densities of the slurry may vary based on a type of solid material, a flow rate of the solid material, a type of fluid, and a fluid flow rate. In an instance when the sold material is a sand, the fluid is water, the solid flow rate is 10000 pounds per minute (lb/m), and the fluid flow rate is 100 cubic feet per minute, flow rates and a density of the slurry may be identified based knowledge of the volumetric density of the sand and the volumetric density of the water. Since sand has a volumetric density of about 100 pounds per cubic foot, the volumetric flow rate of the sand is 10000 divided by 100 or 100 cubic feet per minute. Since, in this example, the flow rates of the fluid and the sand are both 100 cubic feet per minute, the resulting slurry will have a volumetric flow rate of 200 cubic feet per minute. Since the volumetric flow rates of the water and the sand are equal, since water has a volumetric density of about 62.3 pounds per cubic foot, and since the sand has a volumetric density of 100 pounds per cubic foot, the density of the slurry equals (62.3+100)=162.3 pounds per cubic foot. Such density calculations may also be updated to account for the temperature of the fluid. This is because the density of fluids can vary significantly with temperature, for example, water has a density of 62.3 pounds per cubic foot at 70 degrees Fahrenheit (F), 61.998 pounds per square foot at 100 F, and 59.84 pounds per square foot at 212 F.

Instead of performing density calculations when performing operations consistent with the present disclosure, reference data may be stored that cross-references mass flow rates of solids and fluid flow rates with a slurry density. As such, once a mass flow rate of a particular type of solid particles is identified and once a fluid flow rate of a type of fluid has been identified, a processor may simply access a lookup table to see if the solids mass flow rate and the fluid flow rate correspond to a desired slurry density. Wellbore processing rules may identify acceptable slurry density levels or ranges of acceptable slurry density levels for a given wellbore operation. A processing rule may identify that operations of a hydraulic fracturing process may continue as long at the density of the slurry is consistent with one or more slurry density threshold levels.

Figure 6:
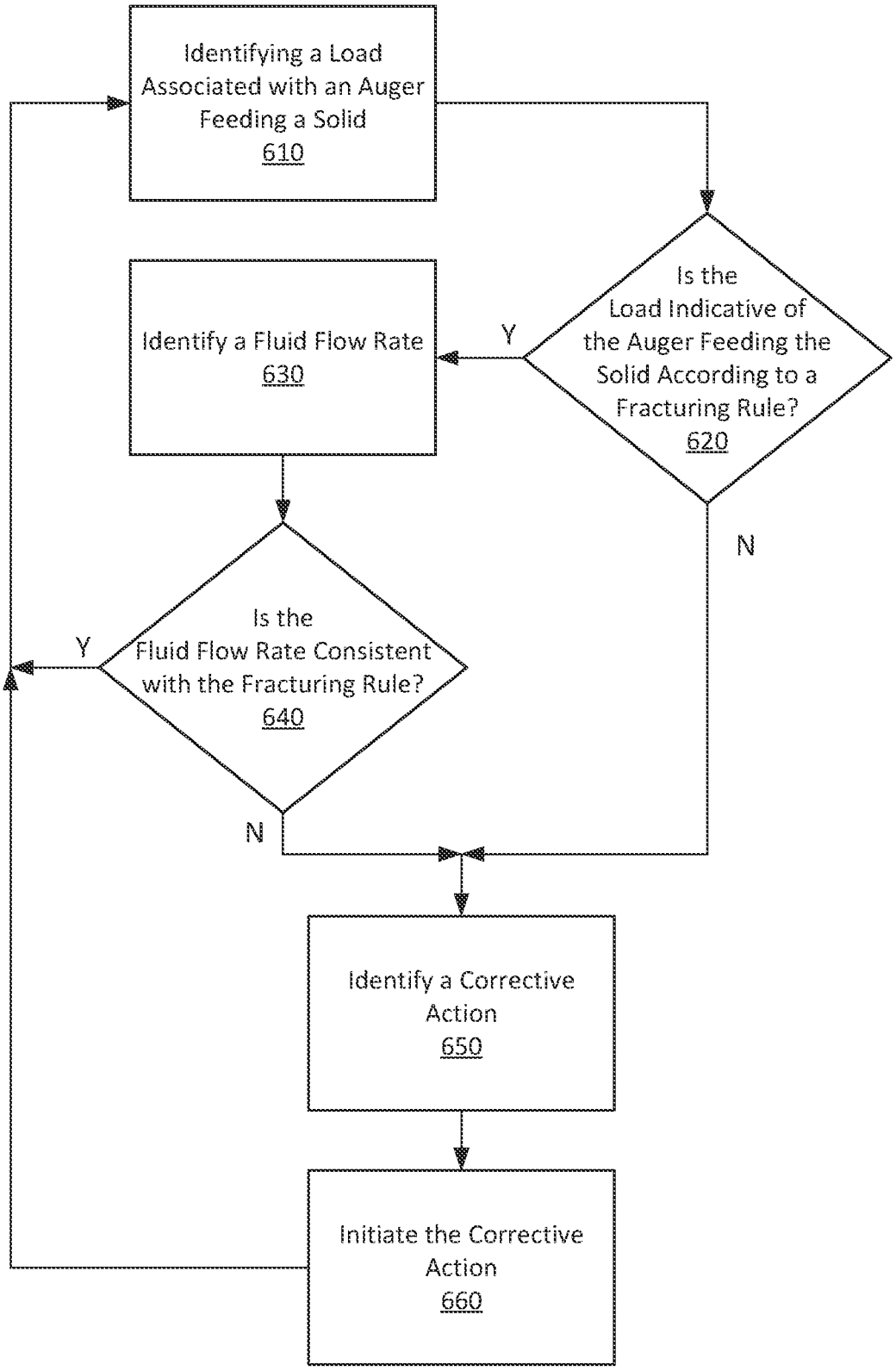
FIG. 6 illustrates an example process for monitoring materials that are provided to make a slurry used during a hydraulic fracturing process such that a density of the slurry can be controlled according to a set of hydraulic fracturing rules.

FIG. 6 illustrates an example process for monitoring materials that are provided to make a slurry used during a hydraulic fracturing process such that a density of the slurry can be controlled according to a set of hydraulic fracturing rules. Operations reviewed in respect to FIG. 6 may be used in conjunction with one or more of the operations performed in respect to the blocks of FIG. 5. At block 610, a load associated with an auger feeding a solid may be identified. This may include identifying the RPM of the auger and identifying a mass flow rate of the solid provided by the auger. A determination may then be made at block 620 regarding whether the auger is feeding the solid according to a fracturing rule. This may include identifying whether the load corresponds to the auger providing a mass flow rate of the solid that is consistent with the fracturing rule. When no, program flow may move to block 650 where a corrective action may be identified. The corrective action performed at block 650 may include sending a message to operators. This corrective action may result in the operators validating that the auger is placed in position where it can actively pickup and feed the solid materials or this corrective action may result in the operators providing additional solid materials to a solid source container.

When operations performed at block 620 identify that the load corresponds to the auger providing a mass flow rate of the solid that is consistent with a hydraulic fracturing rule, program flow may move to block 630 where a fluid flow rate is identified. This fluid flow rate may be a volumetric flow rate of a fluid that is mixed with solid particles provided by the auger. A determination may be made at block 640 relating to whether the fluid flow rate is consistent with the fracturing rule, when no program flow may move to block 650 where a corrective action is identified. This corrective action may include sending a message to operators instructing them to check equipment that provides the fluid and correct any issue relating to that equipment. Here, the corrective action may result in a repair being performed on the equipment that provides the fluid. When the fluid flow rate is consistent with the fracturing rule, program flow may move back to block 610 where the load associated with the auger feeding the solid is identified again.

After a corrective action is identified at block 650, the corrective action may be initiated at block 660. As mentioned above, this may include sending a message to operators to perform actions that result in adequate volumes of solids and/or fluid being provided to a slurry blender apparatus. After the corrective action is performed, program flow may move back to block 610 where the load associated with the auger feeding the solid is identified again.

Figure 7:
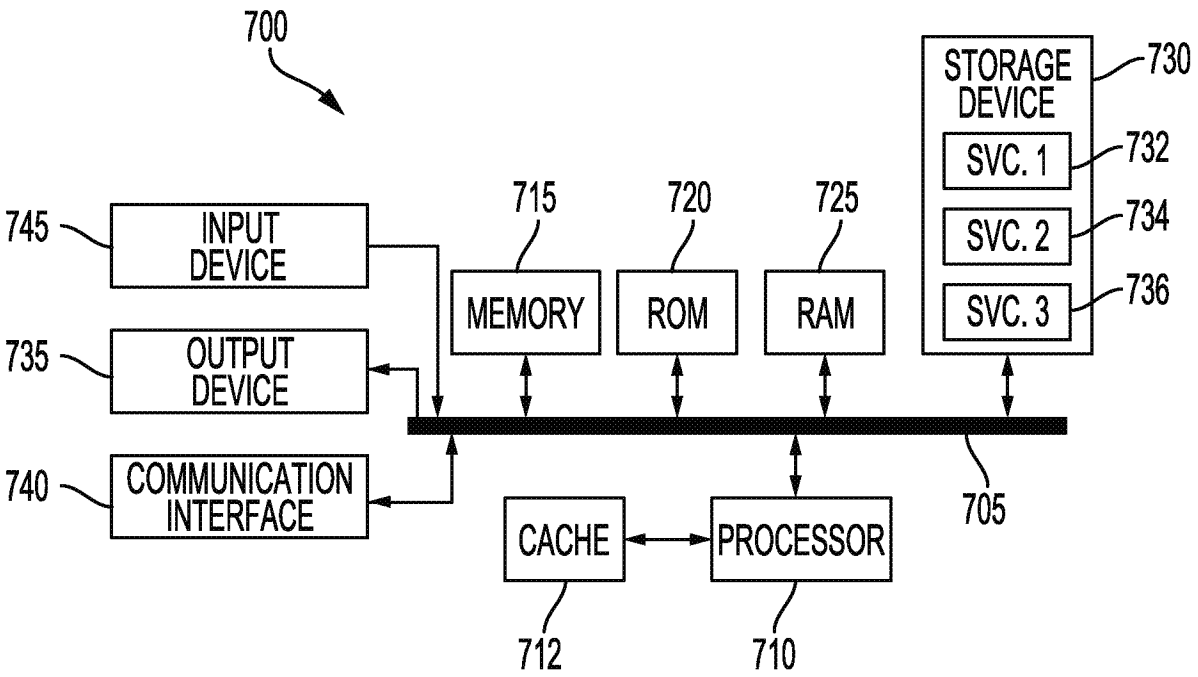
FIG. 7 illustrates an example computing device architecture 700 which can be employed to perform any of the systems and techniques described herein.

FIG. 7 illustrates an example computing device architecture 700 which can be employed to perform any of the systems and techniques described herein. In some examples, the computing device architecture can be integrated with the electromagnetic imager tools described herein. Further, the computing device can be configured to implement the techniques of controlling borehole image blending through machine learning described herein.

The components of the computing device architecture 700 are shown in electrical communication with each other using a connection 705, such as a bus. The example computing device architecture 700 includes a processing unit (CPU or processor) 710 and a computing device connection 705 that couples various computing device components including the computing device memory 715, such as read only memory (ROM) 720 and random-access memory (RAM) 725, to the processor 710.

The computing device architecture 700 can include a cache of high-speed memory connected directly with, in close proximity to, or integrated as part of the processor 710. The computing device architecture 700 can copy data from the memory 715 and/or the storage device 730 to the cache 712 for quick access by the processor 710. In this way, the cache can provide a performance boost that avoids processor 710 delays while waiting for data. These and other modules can control or be configured to control the processor 710 to perform various actions. Other computing device memory 715 may be available for use as well. The memory 715 can include multiple different types of memory with different performance characteristics. The processor 710 can include any general-purpose processor and a hardware or software service, such as service 1 732, service 2 734, and service 3 736 stored in storage device 730, configured to control the processor 710 as well as a special-purpose processor where software instructions are incorporated into the processor design. The processor 710 may be a self-contained system, containing multiple cores or processors, a bus, memory controller, cache, etc. A multi-core processor may be symmetric or asymmetric.

To enable user interaction with the computing device architecture 700, an input device 745 can represent any number of input mechanisms, such as a microphone for speech, a touch-sensitive screen for gesture or graphical input, keyboard, mouse, motion input, speech and so forth. An output device 735 can also be one or more of a number of output mechanisms known to those of skill in the art, such as a display, projector, television, speaker device, etc. In some instances, multimodal computing devices can enable a user to provide multiple types of input to communicate with the computing device architecture 700. The communications interface 740 can generally govern and manage the user input and computing device output. There is no restriction on operating on any particular hardware arrangement and therefore the basic features here may easily be substituted for improved hardware or firmware arrangements as they are developed.

Storage device 730 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 725, read only memory (ROM) 720, and hybrids thereof. The storage device 730 can include services 732, 734, 736 for controlling the processor 710. Other hardware or software modules are contemplated. The storage device 730 can be connected to the computing device connection 705. In one aspect, a hardware module that performs a particular function can include the software component stored in a computer-readable medium in connection with the necessary hardware components, such as the processor 710, connection 705, output device 735, and so forth, to carry out the function.

For clarity of explanation, in some instances the present technology may be presented as including individual functional blocks including functional blocks comprising devices, device components, steps or routines in a method implemented in software, or combinations of hardware and software.

In some instances, the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific examples and aspects thereof, but those skilled in the art will recognize that the application is not limited thereto. Thus, while illustrative examples and aspects of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, examples and aspects of the systems and techniques described herein can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate examples, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Methods and apparatus of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Such methods may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of" a set and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

Illustrative aspects of the disclosure include:

Aspect 1. A method comprising, monitoring a load associated with an auger of a slurry blender that mixes and feeds a slurry into a wellbore line; determining that the auger is actively feeding a solid based on the load being indicative of the auger feeding a solid when the slurry blender forms the slurry; measuring a revolution per minute (RPM) of the auger while the auger actively feeds the solid when the slurry is formed; and identifying, in response to the determination that the auger is actively feeding the solid to form the slurry, a slurry rate of the slurry blender in feeding the slurry into the wellbore line based on the RPM of the auger while the auger actively feeds the solid.

Aspect 2. The method of Aspect 1, further comprising comparing the load associated with the auger feeding the solid to a threshold load; and determining that the load is indicative of the auger actively feeding the solid based on the comparison of the load to the threshold load.

Aspect 3. The method of any of Aspects 1 or Aspect 2, wherein the load is measurable through a hydraulic pressure of a hydraulic system operating to drive the auger, the method further comprising accessing sensor data that indicates the hydraulic pressure of the hydraulic system; comparing the hydraulic pressure to the threshold load; and determining that the hydraulic pressure during operation of the auger is indicative of the auger feeding the solid into the slurry blender based on the comparison of the hydraulic pressure to the threshold load.

Aspect 4. The method of any of Aspects 1 through Aspect 3, wherein the load is a function of an electric current provided to a motor that drives the auger. The method, further comprising accessing sensor data that indicates the electric current when the motor drives the auger; comparing the electric current to the threshold load; and determining that the electric current during operation of the auger is indicative of the auger feeding the solid into the slurry blender based on the comparison of the electric current to the threshold load.

Aspect 5. The method of any of Aspects 1 through Aspect 4, wherein the load is a function of electric power provided to a motor that drives the auger. The method, further comprising accessing sensor data that indicates the electric current provided to the motor when the motor drives the auger; calculating the electric power provided to the motor by multiplying a voltage provided to the motor times the electric current provided to the motor; and determining that the power provided to the motor during operation of the auger is indicative of the auger feeding the solid into the slurry blender.

Aspect 6. The method of any of Aspects 1 through Aspect 5, further comprising estimating a flow rate of the solid provided by the auger based on an equation of (the solid flow rate)=(the RPM)*[(solid mass/auger revolution)]; and identifying the slurry rate based on the flow rate of the solid provided by the auger.

Aspect 7. The method of any of Aspects 1 through Aspect 6, further comprising measuring a fluid flow rate, the fluid flow rate corresponding to a rate at which a fluid is provided to the slurry blender, wherein the slurry rate is identified based on the slurry rate being a function of the flow rate of the solid provided by the auger and the fluid flow rate.

Aspect 8. The method of any of Aspects 1 through Aspect 7, further comprising identifying a solid type of the solid; and identifying the slurry rate based on the solid type of the solid.

Aspect 9. The method of any of Aspects 1 through Aspect 8, further comprising controlling the slurry rate into the wellbore line during a fracturing completion based on the identified slurry rate and completion plan for the fracturing completion.

Aspect 10. The method of any of Aspects 1 through Aspect 9, further comprising monitoring a pump load level associated with a pump that pumps the slurry after the slurry blender mixes the solid with a fluid; identifying that the pump load level does not correspond to a threshold pump load level; and initiating a corrective action based on the load level associated with the pump not corresponding to the threshold pump load level.

Aspect 11. The method of any of Aspects 1 through Aspect 10, further comprising identifying a flow rate of a fluid from data received from a flow meter that provides the fluid to the slurry blender; identifying a volume of fluid that passes though the flow meter in a unit of time; and continuing to provide the slurry to the wellbore based on the identified volume of the fluid being consistent with requirements of a hydraulic fracturing completion.

Aspect 12. An apparatus comprising an auger that provides a solid to include in a slurry that is provided to a wellbore line; a first sensor that senses data associated with a load of the auger; a second sensor that senses data associated with a revolution per minute (RPM) of the auger; a memory; and one or more processors that executes instructions out of the memory to: monitor the data received from the first sensor to identify the load associated with the auger, determine that the auger is actively feeding a solid based on the load being indicative of the auger feeding the solid to form the slurry, identify the RPM of the auger based on the data sensed by the second sensor while the auger actively feeds the solid to form the slurry, and identify a slurry rate based on the RPM of the auger while the auger actively feeds the solid, wherein the slurry rate is identified in response to the determination that the auger is actively feeding the solid to form the slurry.

Aspect 13. The apparatus of Aspect 12, wherein the one or more processors executes the instructions out of the memory to compare the load associated with the auger feeding the solid to a threshold load, and to determine that the load is indicative of the auger actively feeding the solid based on the comparison of the load to the threshold load.

Aspect 14. The apparatus of any of Aspects 12 through Aspect 13, further comprising a hydraulic motor that turns the auger; and a hydraulic fluid that is provided to power the hydraulic motor to turn the auger, wherein the load is measurable through a hydraulic pressure of the hydraulic fluid, and the one or more processors executes the instructions to: identify the hydraulic pressure of the hydraulic fluid when the hydraulic motor turns the auger, compare the hydraulic pressure to the threshold load, and determine that the hydraulic pressure is indicative of the auger feeding the solid based on the comparison of the hydraulic pressure to the threshold load.

Aspect 15. The apparatus of any of Aspects 12 through Aspect 14, further comprising an electric motor that drives the auger, wherein the load is a function of an electric current provided to the electric motor that turns the auger, and wherein the one or more processors executes the instructions to: identify an electric current when the electric motor turns the auger; compare the electric current to the threshold load, and determine that the electric current during operation of the auger is indicative of the auger feeding the solid based on the comparison of the electric current to the threshold load.

Aspect 16. The apparatus of any of Aspects 12 through Aspect 15, further comprising a flow meter that measures a fluid flow rate, the fluid flow rate corresponding to a rate at which a fluid is provided when the slurry is formed, wherein the slurry rate corresponds to a sum of the fluid flow rate and a flow rate of the solid provided by the auger.

Aspect 17. A non-transitory computer-readable storage medium having embodied thereon instructions executable by one or more processors to implement a method comprising monitoring a load associated with an auger of a slurry blender that mixes and feeds a slurry into a wellbore line; determining that the auger is actively feeding the solid based on the load being indicative of the auger feeding a solid when the slurry blender forms the slurry; measuring a revolution per minute (RPM) of the auger while the auger actively feeds the solid when the slurry is formed; and identifying, in response to the determination that the auger is actively feeding the solid to form the slurry, a slurry rate of the slurry blender in feeding the slurry into the wellbore line based on the RPM of the auger while the auger actively feeds the solid.

Aspect 18. The non-transitory computer-readable storage medium of Aspect 17, wherein the one or more processors execute the instructions to compare the load associated with the auger feeding the solid to a threshold load; and to determine that the load is indicative of the auger actively feeding the solid based on the comparison of the load to the threshold load.

Aspect 19. The non-transitory computer-readable storage medium of any of aspects 17 through 18, wherein the load is measurable through a hydraulic pressure of a hydraulic system operating to drive the auger, and the one or more processors execute the instructions to: access sensor data that indicates the hydraulic pressure of the hydraulic system; compare the hydraulic pressure to the threshold load; and determine that the hydraulic pressure during operation of the auger is indicative of the auger feeding the solid into the slurry blender based on the comparison of the hydraulic pressure to the threshold load.

Aspect 20. The non-transitory computer-readable storage medium of any of aspects 17 through 19, wherein the load is a function of an electric current provided to a motor that drives the auger, and the one or more processors execute the instructions to: access sensor data that indicates the electric current when the motor drives the auger; compare the electric current to the threshold load; and determine that the electric current during operation of the auger is indicative of the auger feeding the solid into the slurry blender based on the comparison of the electric current to the threshold load.

What is claimed is:

1. A method comprising:

monitoring power provided to an auger of a slurry blender that mixes and feeds a slurry into a wellbore line;

determining that the auger is actively feeding a solid based on the power provided to the auger being indicative of the auger feeding the solid when the slurry blender forms the slurry;

measuring a revolution per minute (RPM) of the auger while the auger actively feeds the solid when the slurry is formed; and identifying, in response to the determination that the auger is actively feeding the solid to form the slurry, a slurry rate of the slurry blender in feeding the slurry into the wellbore line based on the RPM of the auger while the auger actively feeds the solid.

2. The method of claim 1, further comprising:

comparing the power provided to the auger a threshold load value; and determining that the power provided to the auger is indicative of the auger actively feeding the solid based on the comparison of the power provided to the auger to the threshold load value.

3. The method of claim 1, wherein the power is measurable through a hydraulic pressure of a hydraulic system operating to drive the auger, the method further comprising:

accessing sensor data that indicates the hydraulic pressure of the hydraulic system;

comparing the hydraulic pressure to a threshold load value; and determining that the hydraulic pressure during operation of the auger is indicative of the auger feeding the solid into the slurry blender based on the comparison of the hydraulic pressure to the threshold load value.

4. The method of claim 1, wherein the power is a function of an electric current provided to a motor that drives the auger, the method further comprising:

accessing sensor data that indicates the electric current when the motor drives the auger;

comparing the electric current to a threshold load value; and determining that the electric current during operation of the auger is indicative of the auger feeding the solid into the slurry blender based on the comparison of the electric current to the threshold load value.

5. The method of claim 1, wherein the power is a function of electric power provided to a motor that drives the auger, the method comprising:

accessing sensor data that indicates an electric current provided to the motor when the motor drives the auger;

calculating the electric power provided to the motor by multiplying a voltage provided to the motor times the electric current provided to the motor; and determining that the power provided to the motor during operation of the auger is indicative of the auger feeding the solid into the slurry blender.

6. The method of claim 1, further comprising:

estimating a flow rate of the solid provided by the auger based on an equation of:

(the solid flow rate)=(the RPM)*[(solid mass/auger revolution)]; and identifying the slurry rate based on the flow rate of the solid provided by the auger.

7. The method of claim 6, further comprising:

measuring a fluid flow rate, the fluid flow rate corresponding to a rate at which a fluid is provided to the slurry blender, wherein the slurry rate is identified based on the slurry rate being a function of the flow rate of the solid provided by the auger and the fluid flow rate.

8. The method of claim 1, further comprising:
identifying a solid type of the solid; and
identifying the slurry rate based on the solid type of the solid.

9. The method of claim 1, further comprising:
controlling the slurry rate into the wellbore line during a fracturing completion based on the identified slurry rate and completion plan for the fracturing completion.

10. The method of claim 1, further comprising:
monitoring a pump load level associated with a pump that pumps the slurry after the slurry blender mixes the solid with a fluid;
identifying that the pump load level does not correspond to a threshold pump load level; and
initiating a corrective action based on the pump load level not corresponding to the threshold pump load level.

11. The method of claim 1, further comprising:
identifying a flow rate of a fluid from data received from a flow meter that provides the fluid to the slurry blender;
identifying a volume of the fluid that passes though the flow meter in a unit of time; and
continuing to provide the slurry to the wellbore based on the identified volume of the fluid being consistent with requirements of a hydraulic fracturing completion.

12. An apparatus comprising:
an auger that provides a solid to include in a slurry that is provided to a wellbore line;
a first sensor that senses data associated with a load of the auger;
a second sensor that senses data associated with revolution per minute (RPM) of the auger;
a memory; and
one or more processors that executes instructions out of the memory to:
monitor the data received from the first sensor to identify the load associated with the auger,
determine that the auger is actively feeding a solid based on the load being indicative of the auger feeding the solid to form the slurry,
identify the RPM of the auger based on the data sensed by the second sensor while the auger actively feeds the solid to form the slurry, and
identify a slurry rate based on the RPM of the auger while the auger actively feeds the solid, wherein the slurry rate is identified in response to the determination that the auger is actively feeding the solid to form the slurry.

13. The apparatus of claim 12, wherein the one or more processors executes the instructions out of the memory to:
compare the load associated with the auger feeding the solid to a threshold load, and
determine that the load is indicative of the auger actively feeding the solid based on the comparison of the load to the threshold load.

14. The apparatus of claim 12, further comprising:
a hydraulic motor that turns the auger; and
a hydraulic fluid that is provided to power the hydraulic motor to turn the auger, wherein the load is measurable through a hydraulic pressure of the hydraulic fluid, and the one or more processors executes the instructions to:
identify the hydraulic pressure of the hydraulic fluid when the hydraulic motor turns the auger,
compare the hydraulic pressure to a threshold load, and
determine that the hydraulic pressure is indicative of the auger feeding the solid based on the comparison of the hydraulic pressure to the threshold load.

15. The apparatus of claim 12, further comprising:
an electric motor that drives the auger, wherein the load is a function of an electric current provided to the electric motor that turns the auger, the one or more processors executes the instructions to:
identify the electric current when the electric motor turns the auger;
compare the electric current to a threshold load, and
determine that the electric current during operation of the auger is indicative of the auger feeding the solid based on the comparison of the electric current to the threshold load.

16. The apparatus of claim 12, further comprising:
a flow meter that measures a fluid flow rate, the fluid flow rate corresponding to a rate at which a fluid is provided when the slurry is formed, wherein the slurry rate corresponds to a sum of the fluid flow rate and a flow rate of the solid provided by the auger.

17. A non-transitory computer-readable storage medium having embodied thereon instructions executable by one or more processors to implement a method comprising:
monitoring power provided to an auger of a slurry blender that mixes and feeds a slurry into a wellbore line;
determining that the auger is actively feeding a solid based on the power provided to the auger being indicative of the auger feeding the solid when the slurry blender forms the slurry;
measuring a revolution per minute (RPM) of the auger while the auger actively feeds the solid when the slurry is formed; and
identifying, in response to the determination that the auger is actively feeding the solid to form the slurry, a slurry rate of the slurry blender in feeding the slurry into the wellbore line based on the RPM of the auger while the auger actively feeds the solid.

18. The non-transitory computer-readable storage medium of claim 17, wherein the one or more processors execute the instructions to:
compare the power provided to the auger a threshold load value; and
determine that the power provided to the auger is indicative of the auger actively feeding the solid based on the comparison of the power provided to the auger to the threshold load value.

19. The non-transitory computer-readable storage medium of claim 17, wherein the power is measurable through a hydraulic pressure of a hydraulic system operating to drive the auger, and the one or more processors execute the instructions to:
access sensor data that indicates the hydraulic pressure of the hydraulic system;
compare the hydraulic pressure to a threshold load value; and
determine that the hydraulic pressure during operation of the auger is indicative of the auger feeding the solid into the slurry blender based on the comparison of the hydraulic pressure to the threshold load value.

20. The non-transitory computer-readable storage medium of claim 17, wherein the power is a function of an electric current provided to a motor that drives the auger, and the one or more processors execute the instructions to:
access sensor data that indicates the electric current when the motor drives the auger;
compare the electric current to a threshold load value; and
determine that the electric current during operation of the auger is indicative of the auger feeding the solid into the slurry blender based on the comparison of the electric current to the threshold load value.

* * * * *